US010832700B2

(12) United States Patent
Zhao

(10) Patent No.: US 10,832,700 B2
(45) Date of Patent: Nov. 10, 2020

(54) SOUND FILE SOUND QUALITY IDENTIFICATION METHOD AND APPARATUS

(71) Applicant: TENCENT TECHNOLOGY (SHENZHEN) COMPANY LIMITED, Shenzhen (CN)

(72) Inventor: Weifeng Zhao, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 154 days.

(21) Appl. No.: 16/058,278

(22) Filed: Aug. 8, 2018

(65) Prior Publication Data

US 2018/0350392 A1 Dec. 6, 2018

Related U.S. Application Data

(63) Continuation of application No. PCT/CN2017/086575, filed on May 31, 2017.

(30) Foreign Application Priority Data

Jun. 1, 2016 (CN) ..... 2016 1 0381626

(51) Int. Cl.
*G10L 25/60* (2013.01)
*G10L 19/02* (2013.01)
(Continued)

(52) U.S. Cl.
CPC ..... *G10L 25/60* (2013.01); *G10L 19/0204* (2013.01); *G10L 19/22* (2013.01);
(Continued)

(58) Field of Classification Search
CPC ..... G10L 25/60
(Continued)

(56) References Cited

U.S. PATENT DOCUMENTS 10,278,637 B2 * 5/2019 Sheinkopf ..... G10L 25/66
10,410,615 B2 * 9/2019 Zhao ..... G10H 1/36
(Continued)

FOREIGN PATENT DOCUMENTS

CN 102394065 A 3/2012
CN 102568470 A 7/2012
(Continued)

OTHER PUBLICATIONS

The World Intellectual Property Organization (WIPO) International Search Report for PCT/CN2017/086575 dated Aug. 25, 2017 10 Pages (including translation).
(Continued)

*Primary Examiner* — Susan I McFadden
(74) *Attorney, Agent, or Firm* — Anova Law Group, PLLC

(57) ABSTRACT

A sound file sound quality identification method is provided. The method includes converting a format of a to-be-identified sound file into a preset reference audio format; performing framing on the sound file to obtain a plurality of frames; and performing Fourier transformation processing on the to-be-identified sound file to obtain a spectrum of each frame. The method also includes performing model matching according to the spectrum of each frame of the to-be-identified sound file to obtain a preliminary classification result of the to-be-identified sound file; determining an energy change point of the to-be-identified sound file according to the spectrum of each frame; and determining a sound quality of the to-be-identified sound file according to the preliminary classification result of the to-be-identified sound file and the energy change point of the to-be-identified sound file.

20 Claims, 5 Drawing Sheets

(51) Int. Cl.

| | |
|---|---|
| ***G10L 19/22*** | (2013.01) |
| ***G10L 25/21*** | (2013.01) |
| *G10L 19/16* | (2013.01) |
| *G10L 25/18* | (2013.01) |

(52) U.S. Cl.
CPC ..... *G10L 25/21* (2013.01); *G10L 19/173* (2013.01); *G10L 25/18* (2013.01)

(58) Field of Classification Search
USPC ..... 704/500
See application file for complete search history.

(56) References Cited

U.S. PATENT DOCUMENTS

| | | | |
|---|---|---|---|
| 2003/0123574 | A1 | 7/2003 | Simeon et al. |
| 2015/0073785 | A1 | 3/2015 | Sharma et al. |
| 2015/0179187 | A1 | 6/2015 | Xiao et al. |

FOREIGN PATENT DOCUMENTS

| | | | |
|---|---|---|---|
| CN | 104103279 | A | 10/2014 |
| CN | 104105047 | A | 10/2014 |
| CN | 104681038 | A | 6/2015 |
| CN | 105070299 | A | 11/2015 |
| CN | 105529036 | A | 4/2016 |
| CN | 106098081 | A | 11/2016 |
| WO | 2014048127 | A1 | 4/2014 |
| WO | 2015078121 | A1 | 6/2015 |

OTHER PUBLICATIONS

Luo, Da et al., "Identifying Compression History of Wave Audio and Its Applications", ACM Transactions on Multimedia Computing, Communications and Applications, vol. 10, No. 3, Apr. 30, 2014 (Apr. 30, 2014), parts 2.2 and 3 19 Pages.

The State Intellectual Property Office of the People's Republic of China (SIPO) Office Action 1 for 201610381626.0 dated Mar. 25, 2020 10 Pages (including translation).

Xiao-Na Xu et al., "Research on Objective Audio Quality Assessment in Compressed Domain", Digital Signal Processing, 2010 vol. 34 No. 04, Dec. 31, 2010. The entire passage. 4 Pages.

Samet Hicsonmenz et al., "Methods for Identifying Traces of Compression in Audio", Communications Signal Processing and their Applications International Conference, Dec. 31, 2013. The entire passage. 6 Pages.

* cited by examiner

SOUND FILE SOUND QUALITY IDENTIFICATION METHOD AND APPARATUS

RELATED APPLICATION

This application is a continuation application of PCT Patent Application No. PCT/CN2017/086575, filed on May 31, 2017, which claims priority to Chinese Patent Application No. 201610381626.0, filed with the Chinese Patent Office on Jun. 1, 2016 and entitled "SOUND FILE SOUND QUALITY IDENTIFICATION METHOD AND APPARATUS", content of all of which is incorporated herein by reference in its entirety.

FIELD OF THE TECHNOLOGY

This application relates to the field of sound file processing technologies and, in particular, to a sound file sound quality identification method and apparatus.

BACKGROUND

Nowadays, multimedia technology constantly progresses, and carriers storing sound files, such as music, have developed from originally magnetic tapes and compact discs (CD) to MP3 (Moving Picture Experts Group Audio Layer III) and even multiple types of multimedia devices such as smart terminals. In addition, for convenience of distribution of sound files, various sound processing technologies and corresponding audio formats are also developed. However, the existing technologies often cannot identify the sound quality of sound files for sound processing.

The disclosed methods and systems are directed to solve one or more problems set forth above and other problems.

SUMMARY

According one aspect of the present disclosure, a sound file sound quality identification method is provided. The method includes: converting a format of a to-be-identified sound file into a preset reference audio format; performing framing on the to-be-identified sound file to obtain a plurality of frames of the to-be-identified sound file; performing Fourier transformation processing on the to-be-identified sound file in the reference audio format, to obtain a spectrum of each frame of the to-be-identified sound file; performing model matching according to the spectrum of each frame of the to-be-identified sound file, to obtain a preliminary classification result of the to-be-identified sound file; determining an energy change point of the to-be-identified sound file according to the spectrum of each frame of the to-be-identified sound file; and determining a sound quality of the to-be-identified sound file according to the preliminary classification result of the to-be-identified sound file and the energy change point of the to-be-identified sound file.

According to another aspect of the present disclosure, another sound file sound quality identification method is provided. The method includes: converting a format of a to-be-identified sound file into a preset reference audio format; performing framing on the to-be-identified sound file to obtain a plurality of frames of the to-be-identified sound file; performing Fourier transformation processing on the to-be-identified sound file in the reference audio format, to obtain a spectrum of each frame of the to-be-identified sound file; performing model matching according to the spectrum of each frame of the to-be-identified sound file, to obtain a preliminary classification result of the to-be-identified sound file; and determining a sound quality of the to-be-identified sound file according to the preliminary classification result of the to-be-identified sound file.

According to another aspect of the present disclosure, another sound file sound quality identification method is provided. The method includes: converting a format of a to-be-identified sound file into a preset reference audio format; performing framing on the to-be-identified sound file to obtain a plurality of frames of the to-be-identified sound file; performing Fourier transformation processing on the to-be-identified sound file in the reference audio format, to obtain a spectrum of each frame of the to-be-identified sound file; determining an energy change point of the to-be-identified sound file according to the spectrum of each frame of the to-be-identified sound file; and determining sound quality of the to-be-identified sound file according to the energy change point of the to-be-identified sound file.

Other aspects of the present disclosure can be understood by those skilled in the art in light of the description, the claims, and the drawings of the present disclosure.

BRIEF DESCRIPTION OF THE DRAWINGS

To describe the technical solutions in the embodiments of the present disclosure more clearly, the following briefly describes the accompanying drawings. Apparently, the accompanying drawings in the following description show merely some embodiments of the present disclosure, and a person of ordinary skill in the art may derive other drawings from these accompanying drawings without creative efforts.

DETAILED DESCRIPTION

Figure 1:
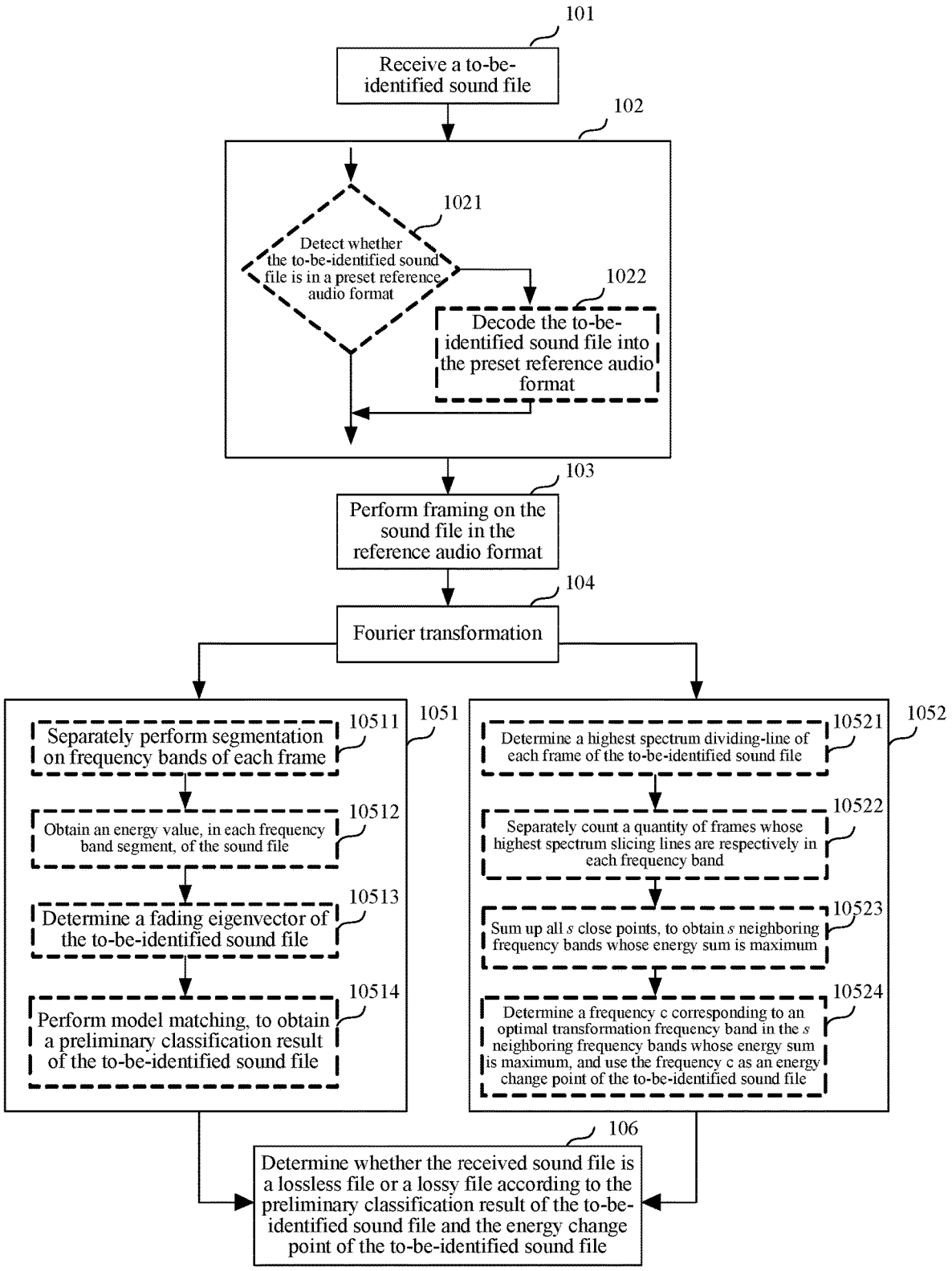
FIG. 1 shows a sound file sound quality identification method according to an embodiment of the present disclosure.

As described above, for convenience of distribution of sound files, various sound processing technologies and corresponding audio formats have been developed. The audio format refers to a format of a digital-format file obtained after analog-digital conversion and other processing are performed on an analog sound signal, and capable of being played or processed in a computer or other multimedia devices.

Generally, the analog-digital conversion of the sound is implemented by using a pulse code modulation (PCM) technology. An audio file obtained by performing the analog-digital conversion on the sound using the PCM technology is referred to as a PCM file. The PCM file obtained by performing the analog-digital conversion on the sound is an original sound file without compression. Generally, the quality of sound (i.e., sound quality) of the PCM file is represented by two parameters: one is a sampling rate, and the other is a sampling precision. The sampling rate indicates the times of sampling per second when a sound is sampled, and is generally between 40 KHz and 50 KHz. The sampling precision indicates the number of bits when each sampled value is quantized, for example, may be 16 bits.

It can be seen from this that, generally a higher sampling rate and a higher sampling precision indicate a better sound quality for an obtained PCM file. On the other hand, a higher sampling rate and a higher sampling precision indicate a larger file size of the obtained PCM file. A standard CD-format is obtained by PCM, with a sampling rate of 44.1 KHz, and a sampling precision of 16 bits (that is, 16-bit quantization). For human ears, sound quality of an audio file in the standard CD-format may be considered as lossless, that is, a sound restored according to the CD-format is basically true to the original sound. For example, generally a musician releases music by using a solid form such as a CD. This type of music retains most original audio characteristics, and sound quality is excellent. However, a file in the standard CD-format has a very large size, and is not convenient to store and distribute, especially when nowadays network applications are currently so popular.

Therefore, many audio compression technologies currently exist, for example, an MP3 technology and an advanced audio coding (AAC) technology. Space occupied by a sound file can be greatly reduced by using these audio compression technologies. For example, if a music file with a same length is stored in a *.mp3 format, storage space occupied may be only 1/10 of an uncompressed file. However, although these audio compression technologies can basically keep a low-frequency part of a sound file from being distorted, these audio compression technologies sacrifice the quality of the 12 KHz to 16 KHz high-frequency part in the sound file for the size of the file. From the perspective of sound quality of the sound file, after compression, the sound suffers distortion more or less, and this distortion is irreversible. For example, after music with lossless CD quality is compressed by a codec into a lossy sound file, even if the lossy sound file is decompressed into an original audio format (such as the PCM format), the quality cannot be restored to the CD quality. Therefore, the compression processing that affects sound quality of a sound file may also be referred to as lossy compression, and these compressed sound files are referred to as lossy sound files.

Generally, whether a sound file is a lossy sound file or a lossless sound file may be determined by using an audio format of the sound file. Generally, a sound file obtained by lossy compression, such as a sound file in an MP3 or AAC format, is undoubtedly a lossy sound file. Therefore, these audio formats may be referred to as lossy audio formats. A sound file that is uncompressed (such as a PCM or WAVE format) or a sound file on which lossless compression (such as a WMA Lossless or FLAC format) is performed should be a lossless sound file. Therefore, these audio formats may be referred to as lossless formats. However, using only the audio formats for such determination cannot determine a false lossless sound file that is obtained by performing lossy compression on a sound file and then restoring the compressed file into the lossless audio format.

Therefore, how to identify sound quality of a sound file, to screen out a truly lossless sound file from sound files in various lossless audio formats, and to eliminate a false lossless sound file is one of problems that need to be currently resolved.

Thus, while a sound file in the lossy audio format is a lossy sound file, a sound file in the lossless audio format may not be a true lossless sound file. Therefore, an embodiment of the present disclosure provides a sound file sound quality identification method. According to the method, a truly lossless sound file can be screened out from sound files in various lossless audio formats, and a false lossless sound file can be found.

As used herein, a to-be-identified sound file may be a file in various lossless audio formats, and may be specifically a sound file without compression or with only lossless compression, for example, may be a PCM file, or may be a sound file in other formats, such as a WAVE format, a WMA Lossless format, or a FLAC format. A sound file in the lossy audio format is considered as a lossy sound file and, therefore, no determination is needed.

FIG. 1 shows a sound file sound quality identification method according to an embodiment of the present disclosure. As shown in FIG. 1, the method in this embodiment includes the followings.

Step 101: Receiving a to-be-identified sound file.

As described above, the to-be-identified sound file may be a file in various lossless audio formats, for example, a sound file in a PCM file format, a WAVE format, a WMA Lossless format, or an FLAC format.

Step 102: Converting the format of the to-be-identified sound file into a preset reference audio format.

In one embodiment of the present disclosure, the preset reference audio format may be a PCM file format whose sampling rate is approximately 44.1 KHz and whose sampling precision is approximately 16 bits. Certainly, the preset reference audio format may be alternatively a PCM file format with other sampling rates or other sampling precision. This is not limited in one embodiment.

In step 102, whether the to-be-identified sound file is in the preset reference audio format may be first detected by using step 1021. If the to-be-identified sound file is in the preset reference audio format, no further processing is required. If the to-be-identified sound file is not in the preset reference audio format, the to-be-identified sound file may be decoded into the preset reference audio format by using step 1022.

Specifically, for a file in various audio formats, the audio format information of the file is recorded in a determined position in the file, and may include information such as an audio format, a sampling rate, a sampling precision, and the like. For example, for a sound file in a *.wav format, audio format information of the sound file is recorded in 44 bytes in a file header. Although for files in different audio formats, audio format information is written in different positions in the sound files, these positions are often standard. Therefore, in step 1021, audio format information of a sound file may be directly read from a corresponding position in the sound file, so that whether the to-be-identified sound file is in the preset reference audio format may be directly determined according to the audio format information of the sound file.

In addition, in step 1022, decoding of a sound file may be implemented by using an all-purpose audio decoding algorithm, for example, may be implemented by using an all-purpose codec open-source library FFmpeg. The codec open-source library FFmpeg can process a file in various audio formats, that is, can decode the file in the various audio formats into the preset reference audio format. For example, it can decode the file into a PCM file with a sampling rate of 44.1 KHz and sampling precision of 16 bits.

Step 103: Performing framing on the sound file that is in the reference audio format and that is outputted in step 102, to obtain a total of X number of frames, where X is a natural number, and the value of X is related to the size of the PCM file.

Specifically, a specified frame length for framing may be set to 2M sampling points, and the frame shift may be set to N sampling points, where M and N are also natural numbers. Further, after the specified frame length and the frame shift are set, the framing may be performed according to the specified frame length and the frame shift.

For example, the specified length for the framing is 2048 sampling points, and the frame shift is 1024 sampling points. In this case, the duration of one frame is 2048/44100 seconds. After such framing processing is performed, from sampling point number 1 to sampling point number 2048 are the first frame; from sampling point number 1025 to sampling point number 3072 are the second frame; from sampling point number 2049 to sampling point number 4096 are the third frame; from sampling point number 3073 to sampling point number 5120 are the fourth frame; and so on.

Step 104: Separately performing Fourier transformation on all the X number of frames after the framing, to obtain a spectrum of each frame. That is, for each frame in the X number of frames of the to-be-identified sound file, energy values of M number of frequency bands may be obtained, that is, M number of components.

As described above, M may be 1024 and, then, for data of each frame, energy values of 1024 frequency bands may be obtained. In this case, the frequency interval of each frequency band is 22050/1024 Hz.

After step 104 is complete, two processes continue to be respectively performed in two branches. One process 1051 is to perform model matching according to the energy values of the M number of frequency bands, to obtain a preliminary classification result of the to-be-identified sound file. The other process 1052 is to determine an energy change point of the to-be-identified sound file according to the energy values of the M number of frequency bands.

In one embodiment of the present disclosure, the sequence of performing the two processes is not limited. For example, the two processes may be simultaneously performed; or one process thereof may be performed first, and then the other process is performed. The following describe the foregoing two processes in detail by using an example.

The following steps 10511 to 10514 describe a specific method for performing model matching according to the energy values of the M number of frequency bands, to obtain a preliminary classification result of the to-be-identified sound file in the foregoing process 1051 in detail.

Step 10511: Separately performing segmentation on the M number of frequency bands of each frame, to obtain L number of frequency band segments for each frame, where L is a natural number.

It should be noted that, the L number of frequency band segments obtained after the foregoing segmentation may partially overlap.

Further, a frequency band number and a frequency shift included in each frequency band segment may be preset, and then the segmentation may be performed according to the set frequency band number and frequency shift. The frequency shift means an interval between first frequency bands of two neighboring frequency band segments. Specifically, when the segmentation is performed on the frequency bands, it may be set that each frequency band segment includes 'a' number of frequency bands, and the frequency shift is 'b' number of frequency bands. In this way, a total of (M−a)/b+1 frequency band segments may be obtained, that is, L=(M−a)/b+1.

For example, M may be 1024, and then after the Fourier transformation, 1024 frequency bands may be obtained for data of each frame. In this case, segmentation may be performed on 1024 frequency bands of each frame, each segment includes 48 frequency bands, and an interval (frequency shift) between first frequency bands of the segments is eight frequency bands. Then, a total of (1024-48)/8+1=123 frequency band segments are obtained. Specifically, for convenience of description, the 1024 frequency bands of each frame are numbered: from frequency band number 1 to frequency band number 1024. After the segmentation, frequency band segment number 1 includes the frequency band number 1 to the frequency band number 48; frequency band segment number 2 includes the frequency band number 9 to the frequency band number 56; frequency band segment number 3 includes the frequency band number 17 to the frequency band number 64; . . . ; and frequency band segment number 123 includes the frequency band number 977 to the frequency band number 1024.

Step 10512: For each frequency band segment, summing up the energy value of each of the frequency bands in the frequency band segment of each of the X number of frames of the sound file, to obtain an energy value of each frequency band segment of the sound file.

Specifically, the energy value of an $i^{th}$ frequency band segment of the sound file may be represented by using $x_i(i\in[1,L])$.

Step 10513: According to the energy value $x_i(i\in[1,L])$ of each frequency band segment of the sound file, determining a fading eigenvector Y of the to-be-identified sound file.

Specifically, the fading eigenvector Y of the to-be-identified sound file may be calculated by using the following formula (1):

$$y_i=x_{i+1}-x_i(i\in[1,L-1]) \tag{1}$$

Herein, $y_i$ is a value of each element in the fading eigenvector Y of the to-be-identified sound file, and indicates an energy difference between neighboring frequency band segments. Therefore, a vector Y including $y_i$ may represent a fading characteristic of the sound file.

Step 10514: Performing model matching on the to-be-identified sound file according to the fading eigenvector of the to-be-identified sound file, to obtain a preliminary classification result of the to-be-identified sound file.

Specifically, support vector machine (SVM) model matching may be performed on the to-be-identified sound file, to obtain a confidence level q between 0 and 1, to represent the preliminary classification result of the to-be-identified sound file. The confidence level q may be understood as a fading speed of a spectrum of the sound file from a low frequency to a high frequency. A confidence level q closer to 0 indicates faster fading of the spectrum of the sound file from the low frequency to the high frequency, and a higher possibility that the sound file is a lossy file. Conversely, a confidence level q farther from 0 indicates a higher possibility that the sound file is a true lossless file.

Specifically, through the model training process before being used, the SVM model generates a group of linear correlation coefficients W, which are referred to as a linear correlation coefficient corresponding to the model. Generally, W is a vector. Then, when the model matching is performed by using the SVM model, the confidence level q may be calculated by using the following formula (2).

$$q=WY \tag{2}$$

where Y is the fading eigenvector of the to-be-identified sound file.

Alternatively, other machine learning algorithms, such as a Gaussian mixture model (GMM) algorithm or a deep neural network (DNN) algorithm, may be used to establish a GMM model or a DNN model replacing the SVM model. By using these models, the model matching may also be performed on the to-be-identified sound file according to the fading eigenvector of the to-be-identified sound file, to obtain a preliminary classification result of the to-be-identified sound file similar to the confidence level q.

After step 10514 is complete, step 106 continues to be performed. Using steps 10521 to 10524, the following describes a specific method for determining the energy change point of the to-be-identified sound file according to the energy values of the M number of frequency bands in the foregoing process 1052 in detail.

Step 10521: Determining a highest spectrum dividing-line of each frame of the to-be-identified sound file.

Specifically, for each frame, the M number of frequency bands may be traversed from the high frequency to the low frequency, to find a frequency band whose first energy value is greater than a first threshold 'm'. This frequency band is referred to as a highest spectrum dividing-line of this frame.

In one embodiment of the present disclosure, the first threshold m may be 0.3 or other empirical values.

After step 10521 is performed, corresponding to each frame of the entire sound file, the number of a frequency band with the highest spectrum dividing-line of each frame may be obtained, and is recorded as $p_i(i\in[1,X])$.

For example, still using the foregoing example, the specified length when the framing is performed on the to-be-identified sound file is set to 2048 sampling points, and then after the Fourier transformation, 1024 frequency bands may be obtained for each frame. If the sound file has a total of three frames, a highest spectrum dividing-line of a first frame is in a $1002^{th}$ frequency band, a highest spectrum dividing-line of a second frame is in a $988^{th}$ frequency band, and a highest spectrum dividing-line of a third frame is in a $1002^{th}$ frequency band, it may be obtained that $p_1=1002$; $p_2=988$; and $p_3=1002$.

Step 10522: According to the frequency band in which the highest spectrum dividing-line of each frame is located, for each frequency band of the M number of frequency bands, respectively counting the number of frames having highest spectrum dividing-lines and recording this number as $r_i(i\in[1,M])$.

Still using the foregoing example, it may be obtained in step 10521 that $p_1=1002$; $p_2=988$; and $p_3=1002$, that is, the highest spectrum dividing-line of the first frame is in the $1002^{th}$ frequency band, the highest spectrum dividing-line of the second frame is in the $988^{th}$ frequency band, and the highest spectrum dividing-line of the third frame is in v 1002 frequency band.

In this case, it may be obtained that, for the 1024 frequency bands, in the $988^{th}$ frequency band, there is a highest spectrum dividing-line of one frame; in the $1002^{th}$ frequency band, there is highest spectrum dividing-lines of two frames; and in another frequency band, there is no highest spectrum dividing-line, that is, it may be obtained that, $r_1\sim r_{987}=0$; $r_{988}=1$; $r_{989}\sim r_{1001}=0$; $r_{1002}=2$ and $r_{1003}\sim r_{1024}=0$.

Step 10523: Summing up all s number of close points in $r_i(i\in[1,M])$, to obtain a total of M−1 numerical values, thereby obtaining s number of neighboring frequency bands with largest energy sums, and record the s number of neighboring frequency bands as l to l+s−1 frequency bands.

Specifically, s is a preset empirical value, for example, may be 50 or another numerical value. The value of s may affect the value of an optimal transformation frequency band that is calculated in the following. For example, there are a total of 1024 frequency bands, the total frequency range is 22050, and the frequency interval of each frequency band is 22050/1024; when s is set to 50, actually the frequency band is approximately 1000 Hz, that is, the size of the optimal transformation frequency band selected in the following is approximately 1000 Hz.

Further still using the foregoing example, it may be obtained in step 10522 that, $r_1\sim r_{987}=0$; $r_{988}=1$; $r_{989}\sim r_{1001}=0$; $r_{1002}=2$; and $r_{1003}\sim r_{1024}=0$.

Then, it may be determined that 50 neighboring frequency bands having largest energy sums may be the $953^{th}$ to $1002^{th}$ frequency bands. In this case, 1 is 953.

Step 10524: Determining a frequency c corresponding to an optimal transformation frequency band in the s number of neighboring frequency bands with largest energy sums, and using the frequency c as an energy change point of the to-be-identified music file.

Specifically, the frequency c corresponding to the optimal transformation frequency band may be calculated by using the following formula (3):

$$c=\left(\frac{\sum_{i=l}^{l+s-1} i\times r_i}{\sum_{i=l}^{l+s-1} i+1}\right)\times\frac{22050}{M} \tag{3}$$

where s is the numerical value that is set in the system; l is the number of the first frequency band in the s number of neighboring frequency bands with largest energy sums; M is the frequency band number obtained after the Fourier transformation is performed on the to-be-identified sound file; and $r_i(i\in[1,M])$ is the number of the highest spectrum dividing-lines in the frequency band.

After step 10524 is complete, step 106 continues to be performed.

Step 106: Determining whether the received sound file is a lossless file or a lossy file according to the preliminary classification result of the to-be-identified sound file and the energy change point of the to-be-identified sound file.

If the preliminary classification result of the to-be-identified sound file is represented by using the confidence level q, and the energy change point is represented by using the frequency c corresponding to the optimal transformation frequency band, two intermediate parameters may be calculated by using the following formulas (4) and (5):

$$d=c-20000 \tag{4}$$

$$e=q-0.5 \tag{5}$$

In this case, if both d and e are greater than 0, it may be determined that the to-be-identified sound file is a lossless file; if both d and e are less than 0, it may be determined that the to-be-identified sound file is a lossy file; in other cases, it cannot be determined whether the to-be-identified sound file is a lossless file or a lossy file, and it needs to be further determined.

Accordingly, the foregoing embodiment provides a sound file sound quality identification method, and a true lossless file and a false lossless file can be identified from sound files in the lossless audio format. In addition, by combining a screening manner using a machine learning model and a screening manner using energy change point detection, various types of sound files can be precisely identified. For example, sound quality of music with different strength, different rhythms, and different styles, such as light music or rock'n'roll can be precisely identified. Tests prove that, identification accuracy of the foregoing method may be as high as 99.07%. In addition, according to the sound file sound quality identification method provided in the disclosed embodiments, without listening to each piece of downloaded music, the user can quickly determine sound quality of the downloaded music, so that the user can quickly screen out music with good sound quality when a download source does not have a sound quality identifier or a sound quality identifier is inaccurate, thereby improving performance of the client-terminal-terminal.

For performing model matching on the to-be-identified sound file according to the fading eigenvector of the to-be-identified sound file, an embodiment of the present disclosure further provides a method for establishing a model by training. In one embodiment of the present disclosure, the model established by training may be a machine learning model such as an SVM model, a GMM model, or a DNN model.

Figure 2:
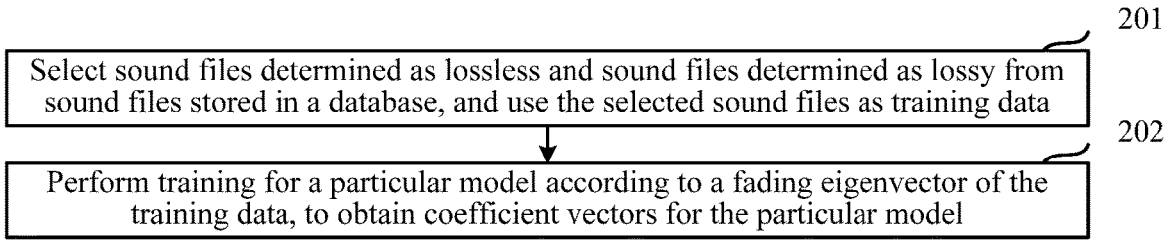
FIG. 2 shows a method for training and establishing a model according to an embodiment of the present disclosure.

FIG. 2 shows a method for establishing a model by training. As shown in FIG. 2, the method may include:

Step 201: Selecting k number of sound files determined as lossless and k number of sound files determined as lossy from sound files stored in a database, and use the selected sound files as training data, where k is a natural number.

The k number of lossless sound files may be sound files that are determined as lossless and that are selected by the user.

In one embodiment of the present disclosure, sound files in a plurality of audio formats may be used as training data of a lossy file. For example, t number of files in 320mp3 format, t number of files in 256 AAC format, and t number of files in 128mp3 format may be selected, where 3t=k, and t is a natural number.

Next, for the k number lossless sound files and k number lossy sound files, steps 102 to 104 and 10511 to 10513 in the process 1051 are separately performed, to obtain a fading eigenvector of the 2 k number of sound files.

Step 202: Performing training for the particular model according to the fading eigenvector of the 2 k number of sound files, to obtain a group of coefficient vectors W for the particular model.

As described in the foregoing, the machine learning model may be a model such as an SVM model, a GMM model, or a DNN model. Test prove that, if an SVM model is established, a radial basis function (RBF) function may be used as a kernel function type, to obtain a relatively good identification effect.

Figure 3:
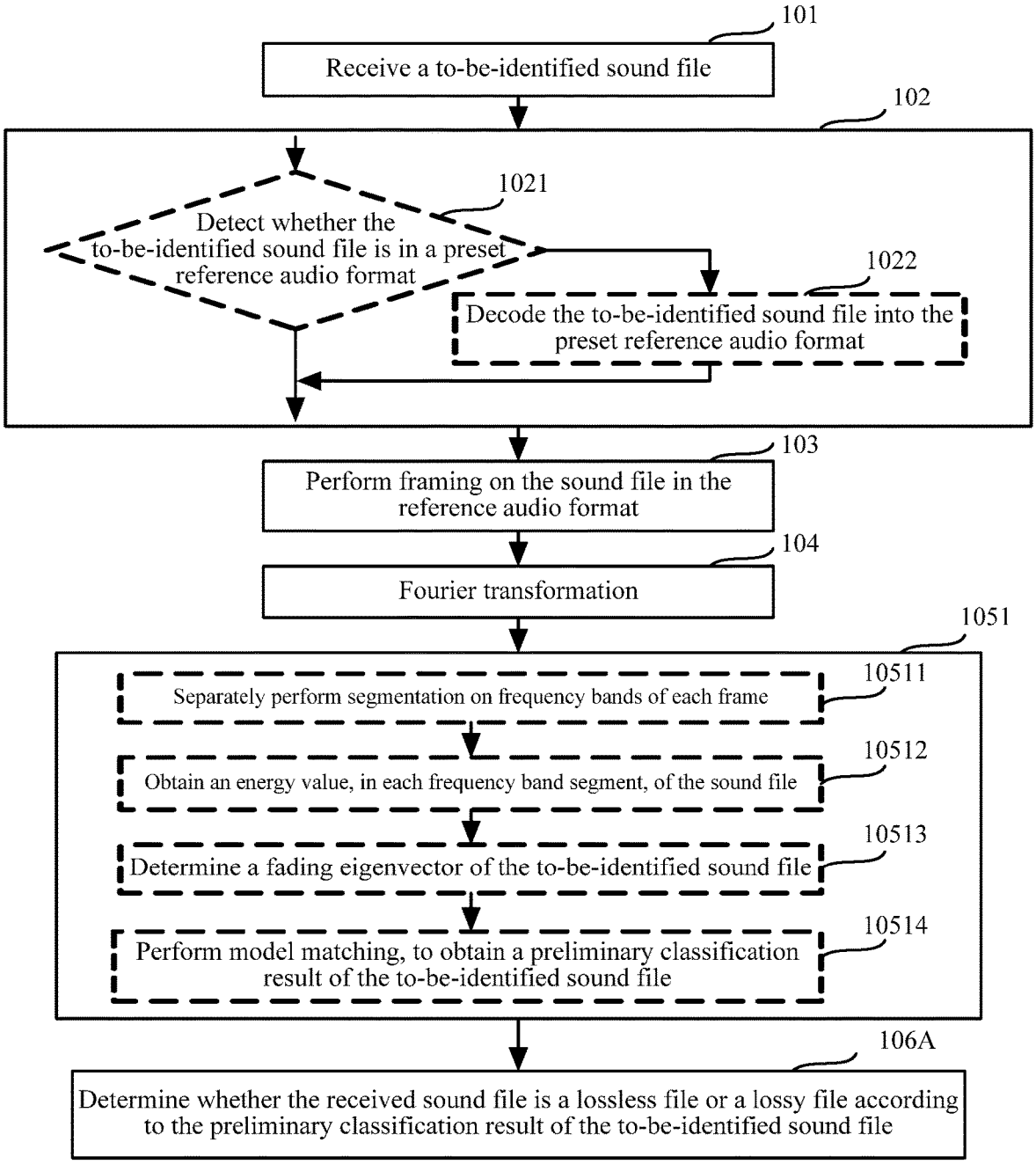
FIG. 3 shows another sound file sound quality identification method according to an embodiment of the present disclosure.

As an alternative simplified solution of the foregoing implementation, in one embodiment of the present disclosure, whether the to-be-identified sound file is a lossy file or a lossless file may be directly determined according to the preliminary classification result of the to-be-identified sound file, that is, steps 101 and 104 and the process 1051 are performed and the process 1052 is not performed. Then, in step 106A, whether the to-be-identified sound file is a lossy sound file may be directly determined according to the preliminary classification result of the to-be-identified sound file. For example, it can be determined that, when the confidence level q is less than or equal to 0.5, the to-be-identified sound file is a lossy file; or when a confidence level q is greater than 0.5, the to-be-identified sound file is a lossless file. The process of the method is shown in FIG. 3.

Figure 4:
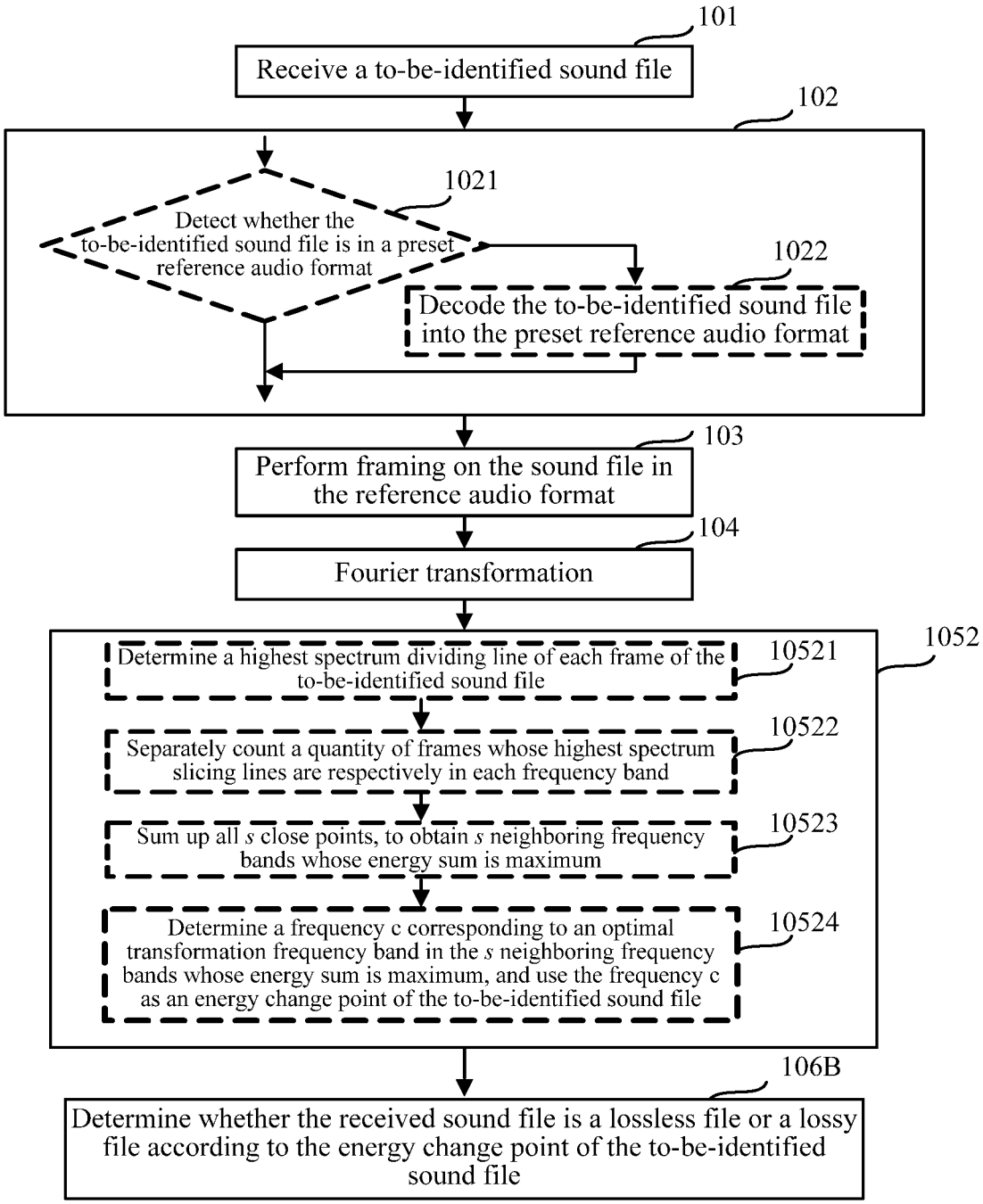
FIG. 4 shows another sound file sound quality identification method according to an embodiment of the present disclosure.

In addition, as another alternative simplified solution of the foregoing implementation, in one embodiment of the present disclosure, whether the to-be-identified sound file is a lossy file or a lossless file may be directly determined according to an energy change point of the to-be-identified music file, that is, steps 101 to 104 and the process 1052 are performed, and the process 1051 is not performed. Then, in step 106B, whether the to-be-identified sound file is a lossy sound file may be directly determined according to the energy change point of the to-be-identified sound file. For example, it can be determined that, when the frequency c corresponding to an optimal transformation frequency band is greater than 20000, the to-be-identified sound file is a lossless file; or when the frequency c corresponding to an optimal transformation frequency band is less than or equal to 20000, the to-be-identified sound file is a lossy file. The process of the method is shown in FIG. 4.

Figure 5:
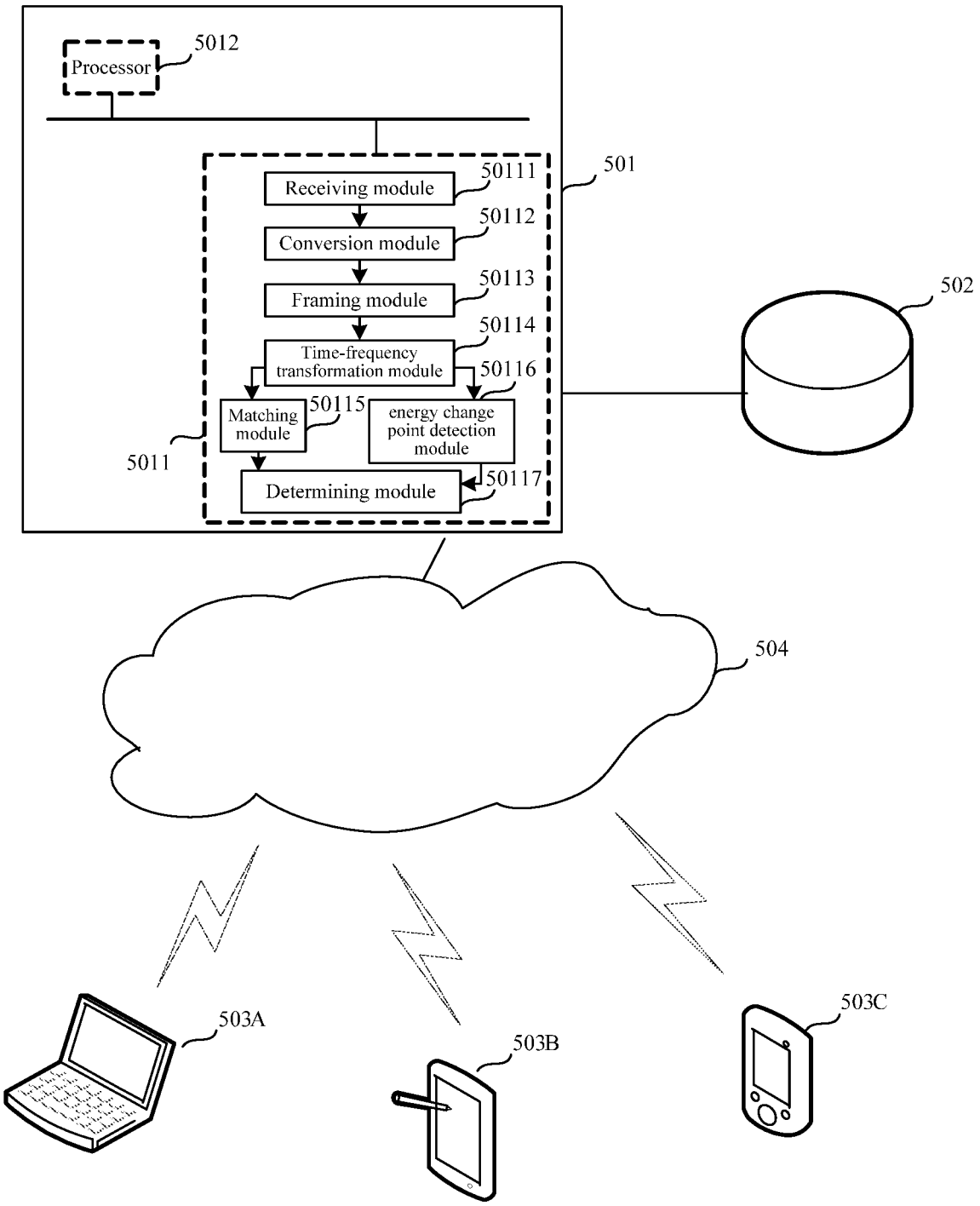
FIG. 5 shows a structure of a music platform according to an embodiment of the present disclosure.

The foregoing sound file sound quality identification method may be applied to a music platform that provides music download and listening services to a customer, for example, a QQ music platform, or a Baidu music platform. FIG. 5 shows an architecture of the music platform. As shown in FIG. 5, generally the music platform 500 includes at least one server 501, at least one database 502, a plurality of client-terminal-terminals 503 (503A, 503B, and 503C), and the like. The server is connected to the client-terminal-terminals by using a network 504, and the server 501 provides various services such as music search, downloading, and online listening to the client-terminal-terminals 503. The client-terminal-terminals 503 provide a user interface to a user, and the user uses the client-terminal-terminals 503 to search for, download, or listen online to music or music information obtained from the server 501. The client-terminal-terminals 503 may be devices such as personal computers, tablet computers, mobile terminals, and music players. The database 502 is configured to store a music file, and may also be referred to as a music library.

Specifically, as shown in FIG. 5, the server 501 of the music platform may include: a memory 5011 configured to store an instruction and a processor 5012 configured to execute the instruction stored in the memory.

In some embodiments of the present disclosure, the memory 5011 stores one or more programs, and is configured to be performed by one or more processors 5012.

The one or more programs may include the following instruction modules: a receiving module 50111, configured to receive a to-be-identified sound file; a conversion module 50112, configured to convert a format of a to-be-identified sound file into a preset reference audio format; a framing module 50113, configured to perform framing on the sound file in the reference audio format, to obtain X number of frames; a time-frequency transformation module 50114, configured to separately perform Fourier transformation on all of the X number of frames after the framing to obtain a spectrum of each frame; a matching module 50115, configured to perform model matching according to the spectrum of each frame of the sound file, to obtain a preliminary classification result of the to-be-identified sound file; an energy change point detection module 50116, configured to determine an energy change point of the to-be-identified sound file according to the spectrum of each frame of the sound file; and a determining module 50117, configured to determine, according to the preliminary classification result of the to-be-identified sound file and the energy change point of the to-be-identified sound file, sound quality of the sound file, that is, whether the sound file is a lossless file or a lossy file. It should be noted that, for specific implementation methods of the foregoing modules, refer to specific implementation methods of the steps in FIG. 1.

As a simplified alternative solution of the foregoing solution, the foregoing instruction modules may include only the following instruction modules: a receiving module 50111, a conversion module 50112, a framing module 50113, a time-frequency transformation module 50114, a matching module 50115, and a determining module 50117A configured to determine, according to the preliminary classification result of the to-be-identified sound file, whether the received sound file is a lossless file or a lossy file. Alternatively, only the following instruction modules may be included: a receiving module 50111, a conversion module 50112, a framing module 50113, a time-frequency transformation module 50114, an energy change point detection module 50116, and a determining module 50117B configured to determine, according to the energy change point of the to-be-identified sound file, whether the received sound file is a lossless file or a lossy file.

Generally, after receiving a music file that is marked as lossless and that is provided by a music provider (such as a signing record company), the server 501 of the music platform may trigger execution of these instructions, and if an execution result is that the music file is determined as a lossless music file, the server 501 of the music platform may upload the music file to the database 502 (music library) of the music platform, and mark the music file as a lossless file, for example, set a sound quality mark of the music file to lossless. In this way, when a user searches for music by using the client-terminal-terminal 503, the server 501 may display or output the found music and a sound quality mark of the found music to the client-terminal-terminal 503, for the user to choose to download or listen online to a lossless music file or a lossy music file.

Figure 6:
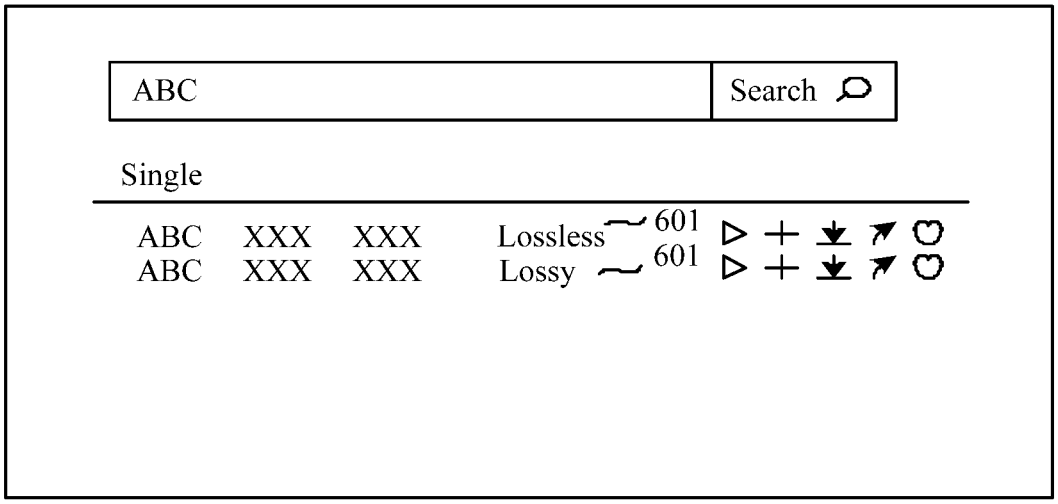
FIG. 6 shows an example of a search interface of a music platform client according to an embodiment of the present disclosure.

If an execution result is that the music file is determined as a lossy music file, a detection result is reported or an exception status is reported to an administrator of the music platform, and the administrator performs subsequent processing. For example, the administrator may communicate with the music provider, to request the music provider to provide a lossless music file, or set the sound quality mark of the music file to lossy and upload the music file to the database. Therefore, quality of music provided by the music platform to a user can be ensured from the source, thereby improving performance of the music platform. FIG. 6 shows an example of a search interface of a music platform client-terminal-terminal. It can be seen from FIG. 6 that, after a user searches for music named "ABC" by using a search function of the client-terminal-terminal, the client-terminal-terminal may display a plurality of (two) search results, and for each found music file, in addition to displaying a music name, an album name, a singer, a resource source, and an option for an operation that can be performed, such as listening, adding to a playlist, local downloading, or adding to favorites, further display a sound quality mark 601 of the music file, to remind a customer whether sound quality of the music file is lossy or lossless.

Further, the server 501 of the music platform may further maintain a machine learning model used for performing model matching. For example, the memory 5011 of the server 501 further includes a model training and establishment instruction module. The module may train and establish a model by using the method shown in FIG. 2, and may further periodically, dynamically, and repeatedly perform training calibration after establishing a model for the first time, thereby optimizing the model.

The sound file sound quality identification method may be further applied to the client-terminal-terminal 503 of the music platform in addition to the foregoing application scenario. Specifically, after downloading the music file by using various channels, the user may invoke an identification function of the client-terminal-terminal, to automatically identify sound quality of the downloaded music file.

Figure 7:
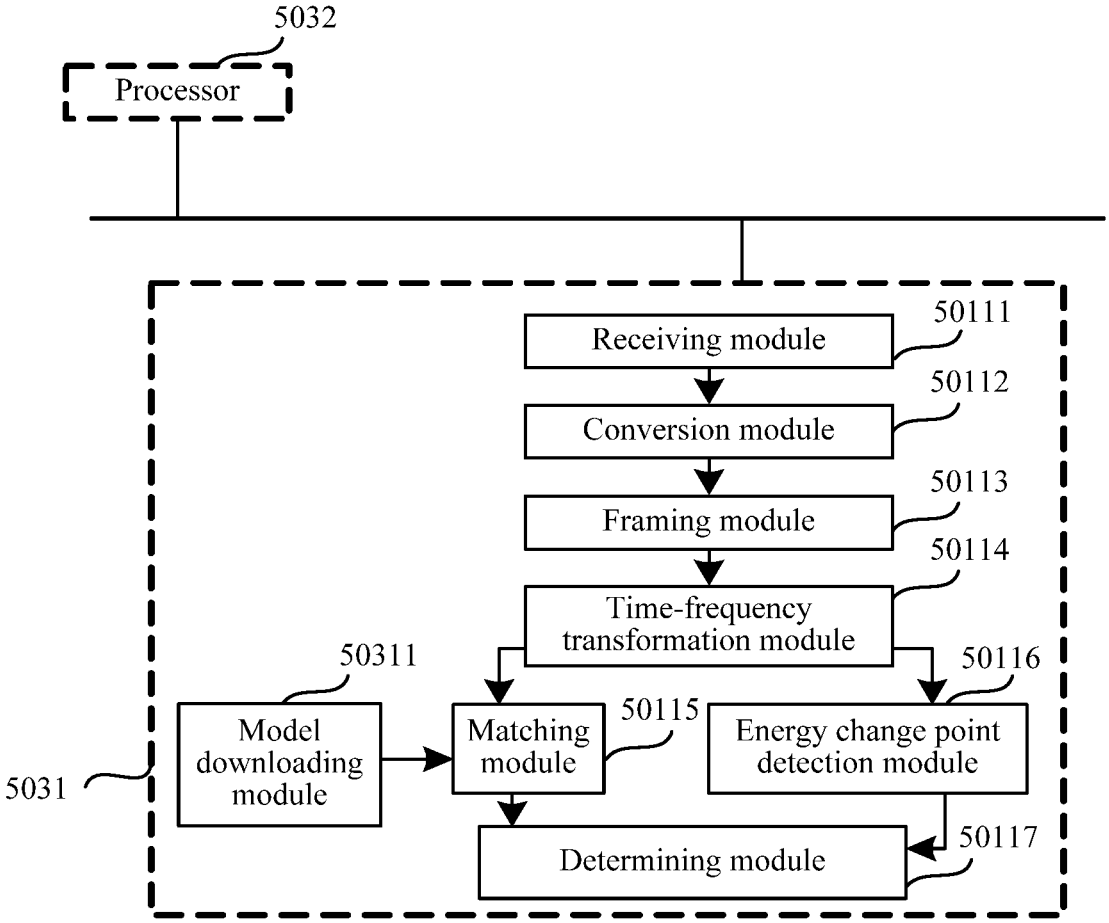
FIG. 7 shows an internal structure of a client-terminal according to an embodiment of the present disclosure.

FIG. 7 shows an internal structure of a client-terminal-terminal 503. As shown in FIG. 7, the client-terminal-terminal 503 includes: a memory 5031 configured to store an instruction and a processor 5032 configured to execute the instruction stored in the memory.

In some embodiments of the present disclosure, the memory 5011 stores one or more programs, and is configured to be performed by one or more processors 5012.

The one or more programs include the following instruction modules: a receiving module 50111, configured to receive a to-be-identified sound file; a conversion module 50112, configured to convert the format of the to-be-identified sound file into a preset reference audio format; a framing module 50113, configured to perform framing on the sound file in the reference audio format, to obtain X number of frames; a time-frequency transformation module 50114, configured to separately perform Fourier transformation on all of the X number of frames after the framing, to obtain a spectrum of each frame; a matching module 50115, configured to perform model matching according to the spectrum of each frame of the music file, to obtain a preliminary classification result of the to-be-identified sound file; an energy change point detection module 50116, configured to determine an energy change point of the to-be-identified sound file according to the spectrum of each frame of the music file; and a determining module 50117, configured to determine, according to the preliminary classification result of the to-be-identified sound file and the energy change point of the to-be-identified sound file, sound quality of the sound file, that is, determine whether the sound file is a lossless file or a lossy file. It should be noted that, for specific implementation methods of the foregoing modules, refer to specific implementation methods of the steps in FIG. 1.

As a simplified alternative solution of the foregoing solution, only the following instruction modules may be included: a receiving module 50111, a conversion module 50112, a framing module 50113, a time-frequency transformation module 50114, a matching module 50115, and a determining module 50117A configured to determine, according to the preliminary classification result of the to-be-identified sound file, whether the received sound file is a lossless file or a lossy file. Alternatively, only the following instruction modules may be included: a receiving module 50111, a conversion module 50112, a framing module 50113, a time-frequency transformation module 50114, an energy change point detection module 50116, and a determining module 50117B configured to determine, according to the energy change point of the to-be-identified sound file, whether the received sound file is a lossless file or a lossy file.

Generally, after a user selects a music file that needs to be identified, and invokes the identification function, the client-terminal-terminal 503 may trigger execution of these instructions, and output an identification result by using an output device, such as a display screen, of the client-terminal-terminal, for reference by the user. In the present disclosure scenario, the user can quickly determine sound quality of downloaded music without listening to each piece of the downloaded music, so as to quickly screen out music with good sound quality when a download source does not have a sound quality mark or a sound quality mark is inaccurate, thereby improving performance of the client-terminal-terminal.

Further, the server 501 of the music platform may still maintain a machine learning model used for performing model matching. For example, the memory 5011 of the server 501 further includes a model training and establishment instruction module. The module may train and establish a model by using the method shown in FIG. 2, and may further periodically, dynamically, and repeatedly perform training calibration after establishing a model for the first time, thereby optimizing the model. In addition, the memory 5011 thereof further includes: a model synchronization module, configured to synchronize an established or optimized model to the client-terminal-terminal 503 by using a network (for example, in a manner of updating client-terminal-terminal software). In this case, the memory of the client-terminal-terminal 503 further includes: a model downloading module 50311, configured to download, from the server, a model used for performing model matching.

A person of ordinary skill in the art may understand that all or some of the procedures of the methods of the foregoing embodiments may be implemented by a computer program instructing related hardware. The program may be stored in a computer readable storage medium. The storage medium may be: a magnetic disk, an optical disc, a read-only memory (ROM), a random access memory (RAM), or the like.

Therefore, the present disclosure further provides a storage medium, which stores a data processing program. The data processing program is used for executing any embodiment of the foregoing method of the present disclosure.

The foregoing descriptions are merely preferred embodiments of the present disclosure, but are not intended to limit the present disclosure. Any modification, equivalent replacement, or improvement made within the spirit and principle of the present disclosure shall fall within the protection scope of the present disclosure.

What is claimed is:

1. A sound file sound quality identification method, comprising:

converting a format of a to-be-identified sound file into a preset reference audio format;

performing framing on the to-be-identified sound file to obtain a plurality of frames of the to-be-identified sound file;

performing Fourier transformation processing on the to-be-identified sound file in the reference audio format, to obtain a spectrum of each frame of the to-be-identified sound file;

performing model matching according to the spectrum of each frame of the to-be-identified sound file, to obtain a preliminary classification result of the to-be-identified sound file;

determining an energy change point of the to-be-identified sound file according to the spectrum of each frame of the to-be-identified sound file; and determining a sound quality of the to-be-identified sound file according to the preliminary classification result of the to-be-identified sound file and the energy change point of the to-be-identified sound file.

2. The method according to claim 1, wherein the reference audio format is a pulse code modulation (PCM) file format with a sampling rate of approximately 44.1 KHz and sampling precision of approximately 16 bits.

3. The method according to claim 1, wherein the converting a format of a to-be-identified sound file into a preset reference audio format comprises:

detecting whether the to-be-identified sound file is in the reference audio format; and when it is determined that the to-be-identified sound file is not in the reference audio format, decoding the to-be-identified sound file into the reference audio format.

4. The method according to claim 1, wherein the performing framing on the to-be-identified sound file in the reference audio format comprises:

setting a specified length and a frame shift, and performing framing on the to-be-identified sound file according to the set specified length and frame shift.

5. The method according to claim 1, wherein the performing model matching according to the spectrum of each frame of the to-be-identified sound file comprises:

separately performing segmentation on frequency bands in the spectrum of each frame to obtain a plurality of frequency band segments;

for each frequency band segment, summing up an energy value of each of the frequency bands in the frequency band segment, to obtain an energy value of each frequency band segment of the sound file determining a fading eigenvector of the to-be-identified sound file according to the energy value of each frequency band segment of the to-be-identified sound file; and performing model matching on the to-be-identified sound file according to the fading eigenvector of the to-be-identified sound file, to obtain the preliminary classification result of the to-be-identified sound file.

6. The method according to claim 5, wherein the separately performing segmentation on frequency bands in the spectrum of each frame comprises:

setting a frequency band number and a frequency shift for each frequency band segment, and performing segmentation according to the set frequency band number and frequency shift.

7. The method according to claim 5, wherein the fading eigenvector Y of the to-be-identified sound file is obtained by using the following formula:

$$y_i = x_{i+1} - x_i (i \in [1, L-1])$$

wherein $x_i(i \in [1,L])$ indicates an energy value of an $i^{th}$ frequency band segment of the to-be-identified sound file, and i is an integer; and the preliminary classification result of the to-be-identified sound file is a confidence level q, which is obtained by using the following formula:

$$q = WY$$

wherein W is a linear correlation coefficient corresponding to a model used when the model matching is performed.

8. The method according to claim 1, wherein the determining an energy change point of the to-be-identified sound file according to the spectrum of each frame of the to-be-identified sound file comprises:

determining a highest spectrum dividing-line of each frame of the to-be-identified sound file;

according to the frequency band with the highest spectrum dividing-line of each frame, separately counting a total number of highest spectrum dividing-lines in each frequency band and recording the total number as $r_i(i \in [1,M])$, wherein $r_i$ indicates a number of highest spectrum dividing-lines in an $i^{th}$ frequency band; and M is a total number of frequency bands;

summing up all s number of close points in $r_i(i\in[1,M])$, to obtain s number of neighboring frequency bands with largest energy sums; and determining a frequency corresponding to an optimal transformation frequency band in the s number of neighboring frequency bands with largest energy sums, and using the frequency as an energy change point of the to-be-identified sound file.

9. The method according to claim 8, wherein the determining a highest spectrum dividing-line of each frame of the to-be-identified sound file comprises:

for each frame, traversing all frequency bands from a high frequency to a low frequency, wherein a first frequency band whose energy value is greater than a first threshold is a highest spectrum dividing-line of this frame.

10. The method according to claim 8, wherein the frequency c corresponding to the optimal transformation frequency band may be obtained by using the following formula:

$$c=\left(\frac{\sum_{i=l}^{l+s-1} i\times r_i}{\sum_{i=l}^{l+s-1} i+1}\right)\times\frac{22050}{M}$$

wherein s is a numerical value; l is a number of a first frequency band in the s number of neighboring frequency bands with largest energy sums; M is a frequency band number obtained after the Fourier transformation is performed on the to-be-identified sound file; and $r_i(i\in[1,M])$ is the number of the highest spectrum dividing-lines in the $i^{th}$ frequency band.

11. The method according to claim 1, wherein the determining sound quality of the to-be-identified sound file according to the preliminary classification result of the to-be-identified sound file and the energy change point of the to-be-identified sound file comprises:

determining that the preliminary classification result of the to-be-identified sound file is a confidence level q, and the energy change point is a frequency c corresponding to the optimal transformation frequency band;

calculating two intermediate parameters d and e as:

$$d=c-20000;$$

$$e=q-0.5;$$

when both d and e are greater than 0, determining that the to-be-identified sound file is a lossless file; and when both d and e are less than 0, determining that the to-be-identified sound file is a lossy file.

12. A sound file sound quality identification method, comprising:

converting a format of a to-be-identified sound file into a preset reference audio format;

performing framing on the to-be-identified sound file to obtain a plurality of frames of the to-be-identified sound file;

performing Fourier transformation processing on the to-be-identified sound file in the reference audio format, to obtain a spectrum of each frame of the to-be-identified sound file;

performing model matching according to the spectrum of each frame of the to-be-identified sound file, to obtain a preliminary classification result of the to-be-identified sound file; and determining a sound quality of the to-be-identified sound file according to the preliminary classification result of the to-be-identified sound file.

13. The method according to claim 12, wherein the performing model matching according to the spectrum of each frame of the to-be-identified sound file comprises:

separately performing segmentation on frequency bands in the spectrum of each frame to obtain a plurality of frequency band segments;

for each frequency band segment, summing up an energy value of each of the frequency bands in the frequency band segment, to obtain an energy value of each frequency band segment of the sound file determining a fading eigenvector of the to-be-identified sound file according to the energy value of each frequency band segment of the to-be-identified sound file; and performing model matching on the to-be-identified sound file according to the fading eigenvector of the to-be-identified sound file, to obtain the preliminary classification result of the to-be-identified sound file.

14. The method according to claim 13, wherein the fading eigenvector Y of the to-be-identified sound file is obtained by using the following formula:

$$y_i=x_{i+1}-x_i(i\in[1,L-1])$$

wherein $x_i(i\in[1, L])$ indicates an energy value of an $i^{th}$ frequency band segment of the to-be-identified sound file, and i is an integer; and the preliminary classification result of the to-be-identified sound file is a confidence level q, which is obtained by using the following formula:

$$q=WY$$

wherein W is a linear correlation coefficient corresponding to a model used when the model matching is performed.

15. The method according to claim 12, wherein the determining sound quality of the to-be-identified sound file according to the preliminary classification result of the to-be-identified sound file comprises:

determining that the preliminary classification result of the to-be-identified sound file is a confidence level q;

when q is greater than a preset threshold, determining that the to-be-identified sound file is a lossless file; and when q is less than or equal to the preset threshold, determining that the to-be-identified sound file is a lossy file.

16. A sound file sound quality identification method, comprising:

converting a format of a to-be-identified sound file into a preset reference audio format;

performing framing on the to-be-identified sound file to obtain a plurality of frames of the to-be-identified sound file;

performing Fourier transformation processing on the to-be-identified sound file in the reference audio format, to obtain a spectrum of each frame of the to-be-identified sound file;

determining an energy change point of the to-be-identified sound file according to the spectrum of each frame of the to-be-identified sound file; and determining sound quality of the to-be-identified sound file according to the energy change point of the to-be-identified sound file.

17. The method according to claim 16, wherein the determining an energy change point of the to-be-identified sound file according to the spectrum of each frame of the to-be-identified sound file comprises:

determining a highest spectrum dividing-line of each frame of the to-be-identified sound file;

according to the frequency band with the highest spectrum dividing-line of each frame, separately counting a total number of highest spectrum dividing-lines in each frequency band and recording the total number as $r_i(i\in[1,M])$, wherein $r_i$ indicates a number of highest spectrum dividing-lines in an $i^{th}$ frequency band; and M is a total number of frequency bands;

summing up all s number of close points in $r_i(i\in[1,M])$, to obtain s number of neighboring frequency bands with largest energy sums; and determining a frequency corresponding to an optimal transformation frequency band in the s number of neighboring frequency bands with largest energy sums, and using the frequency as an energy change point of the to-be-identified sound file.

18. The method according to claim 17, wherein the determining a highest spectrum dividing-line of each frame of the to-be-identified sound file comprises:

for each frame, traversing all frequency bands from a high frequency to a low frequency, wherein a first frequency band whose energy value is greater than a first threshold is a highest spectrum dividing-line of this frame.

19. The method according to claim 17, wherein the frequency c corresponding to the optimal transformation frequency band may be obtained by using the following formula:

$$c = \left( \frac{\sum_{i=l}^{l+s-1} i \times r_i}{\sum_{i=l}^{l+s-1} i + 1} \right) \times \frac{22050}{M}$$

wherein s is a numerical value; l is a number of a first frequency band in the s number of neighboring frequency bands with largest energy sums; M is a frequency band number obtained after the Fourier transformation is performed on the to-be-identified sound file; and $r_i(i\in[1,M])$ is the number of the highest spectrum dividing-lines in the $i^{th}$ frequency band.

20. The method according to claim 16, wherein the determining sound quality of the to-be-identified sound file according to the energy change point of the to-be-identified sound file comprises:

determining that the energy change point is a frequency c corresponding to an optimal transformation frequency band;

when the frequency c is greater than a preset threshold, determining that the to-be-identified sound file is a lossless file; and when the frequency c is less than or equal to a preset threshold, determining that the to-be-identified sound file is a lossy file.

* * * * *